US007748445B2

(12) United States Patent
Wells et al.

(10) Patent No.: US 7,748,445 B2
(45) Date of Patent: Jul. 6, 2010

(54) TOP DRIVE WITH SHAFT SEAL ISOLATION

(75) Inventors: Lawrence Edward Wells, Yorba Linda, CA (US); Preston R. Fox, Fountain Valley, CA (US); Darrin Lynn Yenzer, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 320 days.

(21) Appl. No.: 12/001,484

(22) Filed: Dec. 11, 2007

(65) Prior Publication Data

US 2008/0210437 A1 Sep. 4, 2008

Related U.S. Application Data

(60) Provisional application No. 60/904,750, filed on Mar. 2, 2007.

(51) Int. Cl.
*E21B 19/22* (2006.01)

(52) U.S. Cl. ..... 166/77.1; 166/379

(58) Field of Classification Search ..... 166/77.1, 166/77.51, 77.52, 379, 380, 84.3; 175/113, 175/57

See application file for complete search history.

(56) References Cited

U.S. PATENT DOCUMENTS

| | | | | |
|---|---|---|---|---|
| 2,589,119 | A | 3/1952 | O'Leary | |
| 2,998,084 | A | 8/1961 | Johnson et al | |
| 4,010,600 | A | 3/1977 | Poole et al. | 57/129 |
| 4,115,911 | A | 9/1978 | Poole et al. | 29/402.12 |
| 4,205,423 | A | 6/1980 | Poole et al. | 29/402.11 |
| 4,421,179 | A | 12/1983 | Boyadjieff | 173/44 |
| 4,449,596 | A | 5/1984 | Boyadjieff | 175/85 |
| 4,458,768 | A | 7/1984 | Boyadjieff | 175/85 |
| 4,529,045 | A | 7/1985 | Boyadjieff et al. | 173/164 |
| 4,589,503 | A | 5/1986 | Johnson et al. | 175/ 113 |
| 4,605,077 | A | 8/1986 | Boyadjieff | 175/85 |
| 4,753,300 | A | 6/1988 | Shaw et al. | 173/164 |
| 4,759,239 | A | 7/1988 | Hamilton et al. | 81/57.34 |
| 4,793,422 | A | 12/1988 | Krasnov | 175/57 |
| 4,799,808 | A | 1/1989 | Otto | 384/481 |
| 4,800,968 | A | 1/1989 | Shaw et al. | 175/85 |
| 4,809,792 | A | 3/1989 | Lynch | 175/113 |
| 4,813,493 | A | 3/1989 | Shaw et al. | 173/164 |
| 4,854,383 | A | 8/1989 | Arnold et al. | 166/70 |
| 4,865,135 | A | 9/1989 | Moses | 175/57 |
| 4,878,546 | A | 11/1989 | Shaw et al. | 173/163 |
| 4,899,832 | A | 2/1990 | Bierscheid, Jr. | 173/23 |
| 5,038,871 | A | 8/1991 | Dinsdale | 175/52 |
| 5,107,940 | A | 4/1992 | Berry | 175/85 |
| 5,251,709 | A | 10/1993 | Richardson | 175/220 |
| 5,255,751 | A | 10/1993 | Stogner | 175/203 |
| 5,381,867 | A | 1/1995 | Berry | 175/85 |

(Continued)

FOREIGN PATENT DOCUMENTS

| | | |
|---|---|---|
| GB | 1 603608 | 5/1978 |

*Primary Examiner*—Daniel P Stephenson
(74) *Attorney, Agent, or Firm*—Williams, Morgan & Amerson, P.C.

(57) ABSTRACT

A top drive system for wellbore drilling operations, the top drive system including a main shaft having an upper shaft seal system with a raised platform for supporting the seal system. The top drive may also have a shroud for covering the seal(s), and contaminants may flow down from the seals, since the seals are raised by the platform.

15 Claims, 5 Drawing Sheets

U.S. PATENT DOCUMENTS

| | | | | |
|---|---|---|---|---|
| 5,388,651 | A | 2/1995 | Berry | 175/85 |
| 5,433,279 | A | 7/1995 | Tessari et al. | 173/213 |
| 5,501,286 | A | 3/1996 | Berry | 175/52 |
| 5,755,296 | A | 5/1998 | Richardson et al. | 175/162 |
| 5,823,541 | A | 10/1998 | Dietle et al. | 277/320 |
| 6,024,181 | A | 2/2000 | Richardson et al. | 175/162 |
| 6,244,345 | B1 | 6/2001 | Helms | 166/301 |
| 6,276,450 | B1 | 8/2001 | Seneviratne | 166/85.1 |
| 6,527,047 | B1 | 3/2003 | Pietras | 166/77.51 |
| 6,536,520 | B1 | 3/2003 | Snider et al. | 166/78.1 |
| 6,622,796 | B1 | 9/2003 | Pietras | 166/379 |
| 6,679,333 | B2 | 1/2004 | York et al. | 166/379 |
| 6,688,398 | B2 | 2/2004 | Pietras | 166/380 |
| 6,705,405 | B1 | 3/2004 | Pietras | 166/380 |
| 6,725,938 | B1 | 4/2004 | Pietras | 166/380 |
| 6,725,949 | B2 | 4/2004 | Seneviratne | 175/85 |
| 6,742,596 | B2 | 6/2004 | Haugen | 166/380 |
| 6,834,860 | B2 | 12/2004 | Rinaldo | 277/418 |
| 6,913,096 | B1 | 7/2005 | Nielsen et al. | 175/85 |
| 6,923,254 | B2 | 8/2005 | Morrow et al. | 166/88.4 |
| 6,935,440 | B2 | 8/2005 | Nelson et al. | 175/52 |
| 6,951,082 | B2 | 10/2005 | Nelson et al. | 52/112 |
| 6,973,979 | B2 | 12/2005 | Carriere et al. | 175/203 |
| 6,994,176 | B2 | 2/2006 | Shahin et al. | 175/423 |
| 7,007,753 | B2 | 3/2006 | Robichaux et al. | 166/291 |
| 7,213,660 | B2 | 5/2007 | Martin | 175/207 |
| 7,222,683 | B2 | 5/2007 | Folk et al. | 175/162 |
| 7,231,969 | B2 | 6/2007 | Folk et al. | 166/77.51 |
| 7,270,189 | B2 | 9/2007 | Brown et al. | 166/380 |
| 7,343,968 | B2 | 3/2008 | Kubala | 166/75.11 |
| 2002/0134555 | A1 | 9/2002 | Allen et al. | 166/377 |
| 2003/0205864 | A1* | 11/2003 | Dietle et al. | 277/434 |
| 2003/0221519 | A1 | 12/2003 | Haugen | 81/57.15 |
| 2007/0251699 | A1 | 11/2007 | Wells et al. | 166/377 |
| 2008/0230274 | A1* | 9/2008 | Stubstad | 175/57 |

* cited by examiner

TOP DRIVE WITH SHAFT SEAL ISOLATION

CROSS-REFERENCE TO RELATED APPLICATION

The present invention and application claim priority under the United States Patent Laws from U.S. Application Ser. No. 60/904,750 field Mar. 2, 2007 which application is incorporated fully herein for all purposes.

BACKGROUND OF THE INVENTION

1. Field of the Invention

This invention is directed to wellbore drilling top drive systems; shaft seal systems for them; and methods of their use.

2. Description of Related Art

The prior art discloses a variety of top drive systems; for example, and not by way of limitation, the following U.S. patents present exemplary top drive systems and components thereof: U.S. Pat. Nos. 4,458,768; 4,807,890; 4,984,641; 5,433,279; 6,276,450; 4,813,493; 6,705,405; 4,800,968; 4,878,546; 4,872,577; 4,753,300; 6,007,105; 6,536,520; 6,679,333; 6,923,254—all these patents incorporated fully herein for all purposes.

Certain typical prior art top drive drilling systems have a derrick supporting a top drive which rotates tubulars, e.g., drill pipe. The top drive is supported from a travelling block beneath a crown block. A drawworks on a rig floor raises and lowers the top drive. The top drive moves on a guide track.

The main shafts of top drives have main shaft bearings which are critical to operation of the top drive and thus to the operation of the drilling rig. Contamination from moisture or leaking drilling fluid is a common cause of failure of main shaft bearings. Leaking drilling fluid can originate from leaks at a top drive's high pressure swivel seal above a top drive main bearing and gear housing. Leaking fluid can then flow down into the top drive bearings and gears.

BRIEF SUMMARY OF THE INVENTION

The present invention, in certain aspects, discloses top drive systems with isolated upper shaft seals. This isolation inhibits contamination of the seals and provides an effective way to protect the top drive's main shaft bearings from contamination. In certain aspects, the upper main shaft seals are located below a high pressure swivel seal and housed on a raised platform above a main bearing/gear housing with a protective shield or shroud surrounding the main shaft seal and the platform. In one aspect, the raised platform containing the upper seal is supported by a cylindrical or conical housing which extends downward to the top of the main bearing/gear housing. The shroud surrounds the upper shaft seal and its cylindrical support; is circumferentially affixed to the main shaft above the upper shaft seal, preventing leakage between the main shaft and the shroud from above; and rotates with the main shaft. Contaminants can flow down and away from the seal which are raised to the extent of the raised platform's height, thus inhibiting contaminant build-up on the seals and facilitating maintenance of seal integrity.

The present invention, in certain aspects, provides a top drive system for wellbore operations, the top drive system including: a main body; a motor apparatus (e.g. one motor, or two spaced-apart motors); a main shaft extending from the main body, the main shaft having a top end and a bottom end, the main shaft having a main shaft flow bore therethrough from top to bottom through which drilling fluid is flowable; a gear system interconnected with the main shaft, the gear system driven by the motor apparatus so that driving the gear system drives the main shaft; upper components connected to the main body above the top end of the main shaft which support high pressure seal apparatus; and an upper shaft seal isolation system. Optionally, there is a quill connected to the main shaft.

The present invention discloses, in certain aspects, top drive systems for wellbore operations, the top drive systems having: a top drive main shaft; a housing enclosing a portion of the top drive main shaft, the portion of the main shaft having an exterior surface; a raised platform adjacent the top drive main shaft; a seal system for sealing an interface with the top drive main shaft; the seal system including seal apparatus on and supported by the raised platform, and the seal apparatus located so that contaminants are flowable down from it.

Accordingly, the present invention includes features and advantages which are believed to enable it to advance oil and gas drilling technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious top drive systems, components and parts thereof, and methods of their use;

Such systems with an effective upper shaft seal isolation system;

Such systems with a raised platform for supporting the shaft seal isolation system;

Such systems with such a raised platform in which contaminants flow down from the seals on the platform inhibiting contaminant build-up on the seals; and Such systems with a protective shroud for covering the shaft seal isolation system.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1:
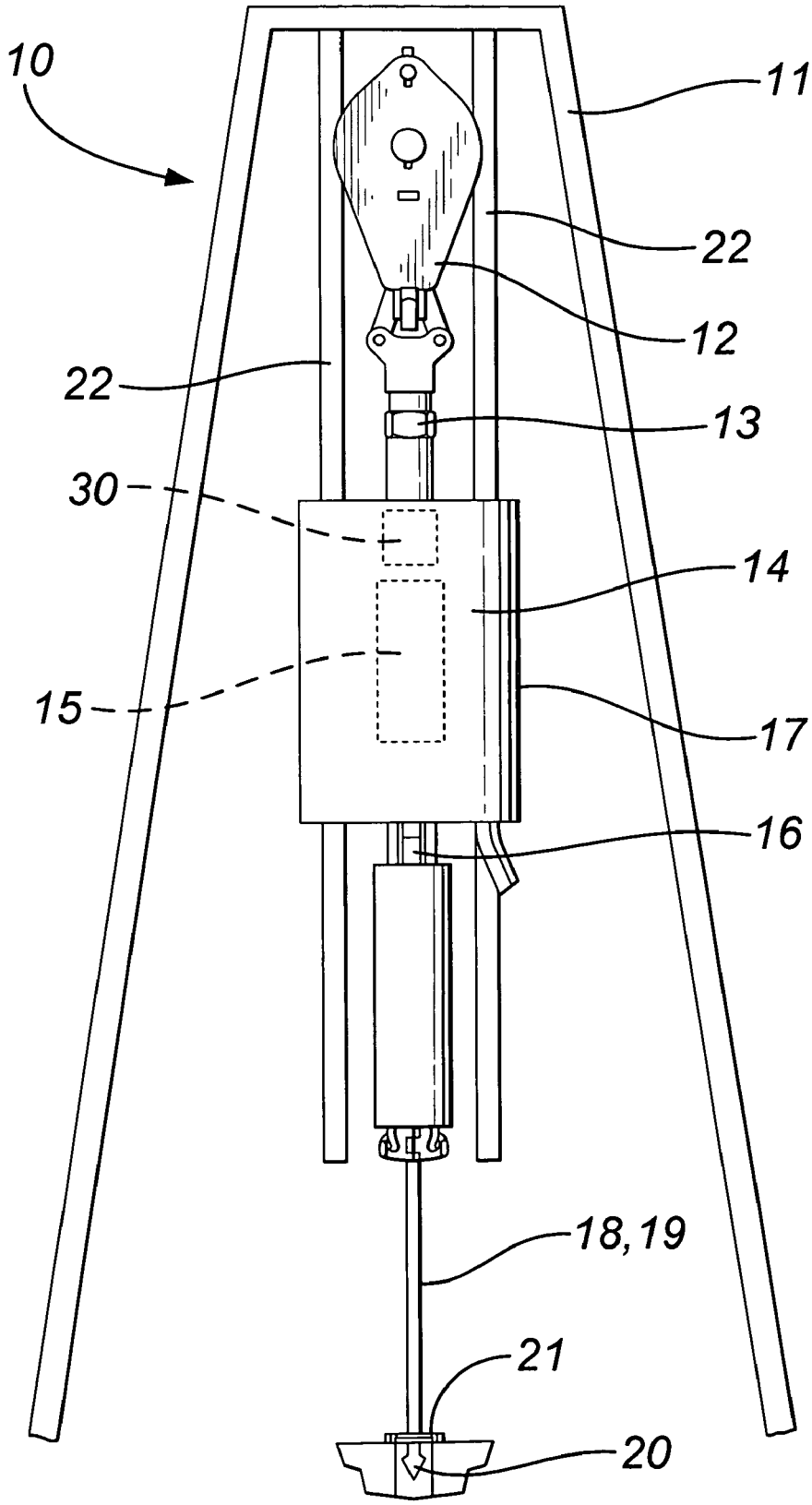
FIG. 1 is a schematic view of a prior art top drive drilling system.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1 illustrates a top drive system according to the present invention which is structurally supported by a derrick 11. The system 10 has a plurality of components including: a swivel 13, a top drive 14 according to the present invention (any top drive referred to or disclosed herein), a main shaft 16, a housing 17, a drill stem 18/drillstring 19 and a drill bit 20. The top drive 14 includes a main shaft seal isolation system 30 (shown schematically) according to the present invention. The components are collectively suspended from a traveling block 12 that allows them to move upwardly and downwardly on one or more rail(s) 22 connected to the derrick 11 for guiding the vertical motion of the components and/or reacting the torque produced by the top drive 14. Torque generated during operations with the top drive or its components (e.g. during drilling) is transmitted through a dolly to the rails 22. The main shaft 16 extends through the motor housing 17 and connects to the drill stem 18. The drill stem 18 is typically threadedly connected to one end of a series of tubular members collectively referred to as the drillstring 19. An opposite end of the drillstring 19 is threadedly connected to a drill bit 20.

During operation, a motor apparatus 15 (shown schematically) encased within the housing 17 rotates the main shaft 16 which, in turn, rotates the drill stem 18/drillstring 19 and the drill bit 20. Rotation of the drill bit 20 produces an earth bore 21. Fluid pumped into the top drive system passes through the main shaft 16, the drill stem 18/drillstring 19, the drill bit 20 and enters the bottom of the earth bore 21. Cuttings removed by the drill bit 20 are cleared from the bottom of the earth bore 21 as the pumped fluid passes out of the earth bore 21 up through an annulus formed by the outer surface of the drill bit 20 and the walls of the bore 21.

Figure 2A:
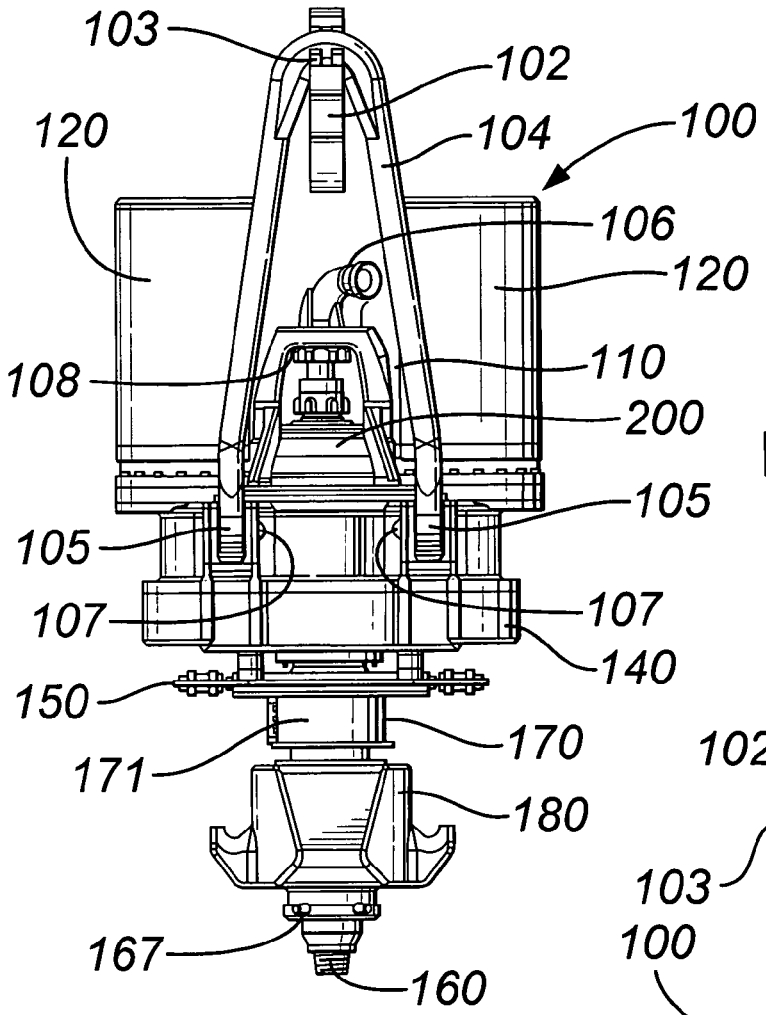
FIG. 2A is a front view of a top drive system according to the present invention.
Figure 2B:
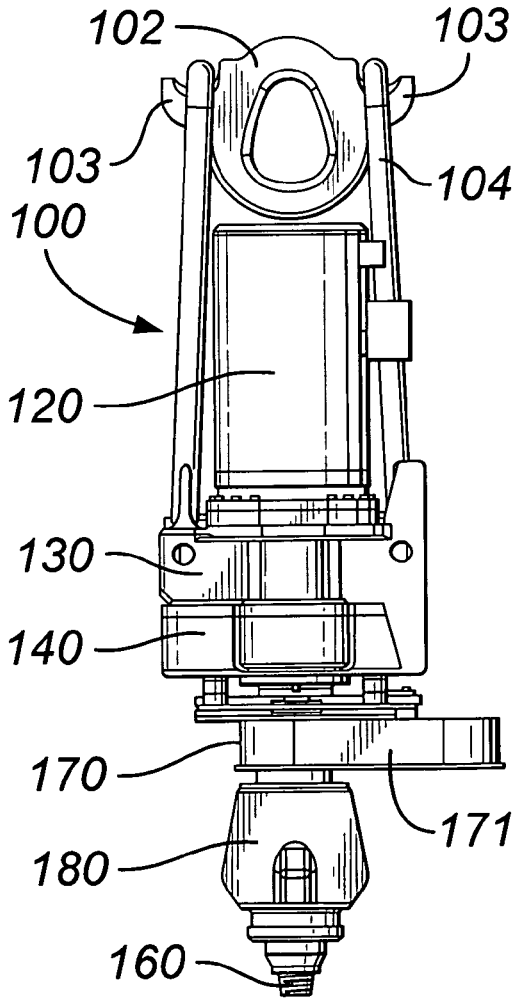
FIG. 2B is a side view of a top drive system according to the present invention.

FIGS. 2A and 2B illustrate a top drive system 100 according to the present invention (which may be used as the top drive system 10, FIG. 1) which has supporting bails 104 suspended from a becket 102. Motors 120 which rotate a main shaft 160 are supported on a main body 130. A bonnet 110 supports a gooseneck 106 and a washpipe 108 through which fluid is pumped to and through the system 100 and through a flow channel through the main shaft 160. Within the bonnet 110 is a shaft seal isolation system 200 (see FIG. 3C) according to the present invention.

A main gear housing 140 encloses a gear system (not shown). A drag chain system 170 encloses a drag chain and associated components. This drag chain system 170 may be used instead of a rotating head and provides sufficient rotation for reorientation of a link adapter 180 and items connected thereto. Optionally, the drag chain system 170 is deleted and a rotating head system is used.

Bolts releasably secure the bonnet 110 to the body 130. Removal of the bolts permits removal of the bonnet 110.

The system 100 is movable on a mast or part of a derrick (like the derrick 11 and on its rails 22) by optional connection to a movable apparatus like a dolly permitting the top drive and associated components to be moved up and down, and toward and away from a well centerline (toward the derrick when drill pipe is connected/disconnected while tripping; and to the well center during drilling and/or hoisting). Known apparatuses and structures are used to move the links 133 and to move the dolly.

Upper parts of the bails 104 extend over and are supported by arms 103 of the becket 102. Each bail 104 has two spaced-apart lower ends 105 pivotably connected by pins 107 to the body 130. Optionally, a single bail is used to support the body 130.

The main shaft, in some embodiments, can be removed from the system 100, to repair the main shaft or to replace the main shaft, without disturbing and without removing the gear case and gearing of the system. To remove the main shaft, the bonnet, gooseneck, washpipe, and associated packing are removed, preferably together as a unit. Bolts 164 that hold the main shaft down are removed. A split ring 167 is removed below the link adapter 180. The main shaft is then removed from the system. During this removal process, all the system gearing and seals have remained in place and no lubricant has been removed or drained.

Figure 3A:
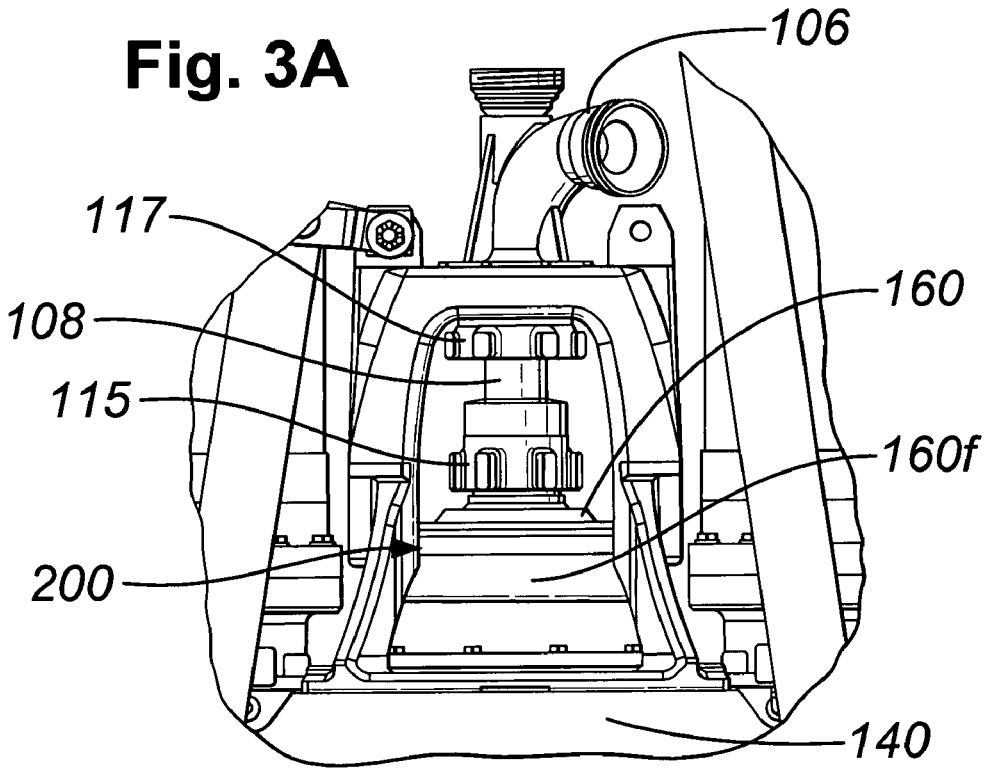
FIG. 3A is a front view of a shaft isolation system according to the present invention.
Figure 3B:
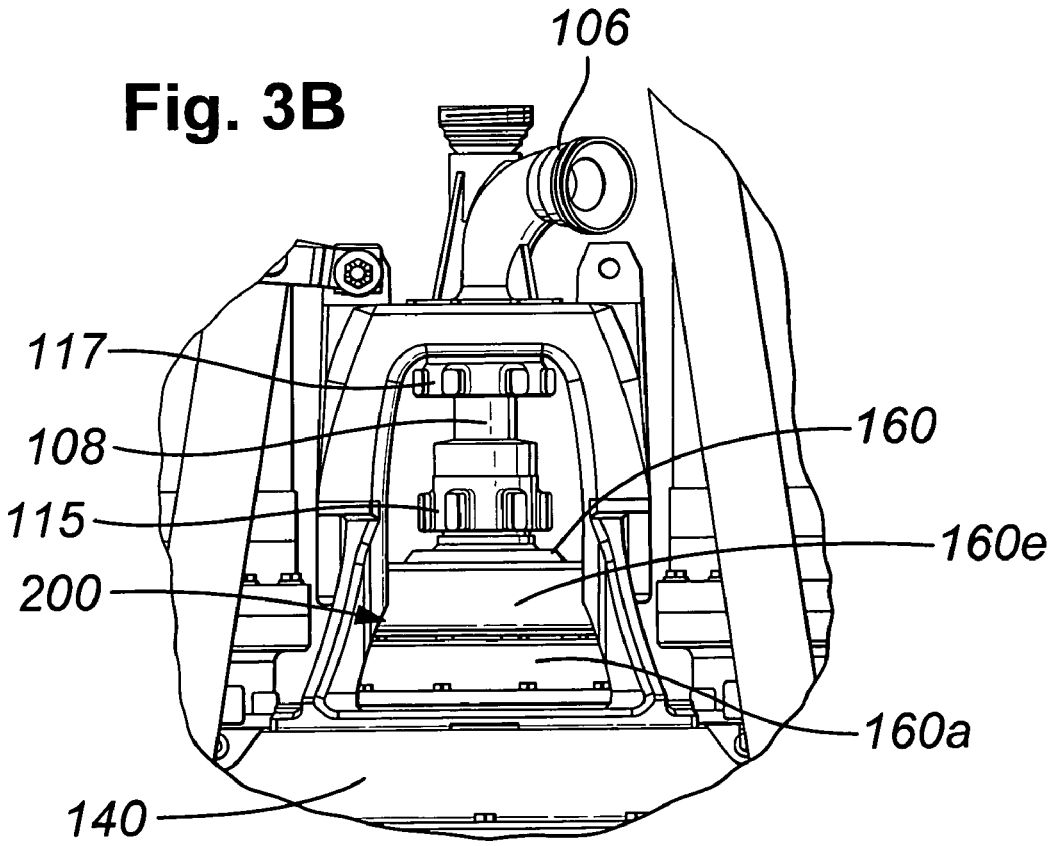
FIG. 3B is a front view of the system of FIG. 3A with a shroud removed.
Figure 3C:
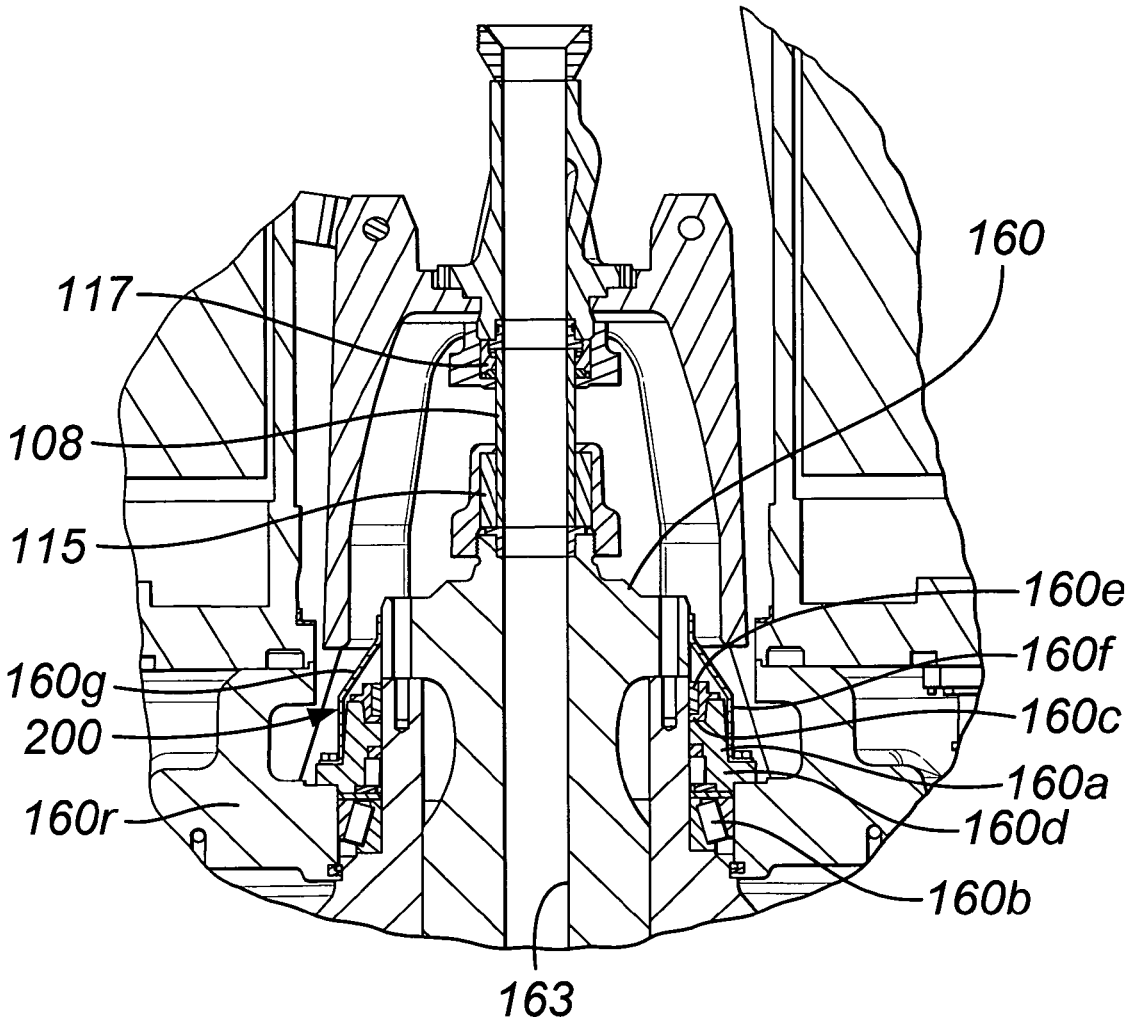
FIG. 3C is a cross-section view of the system of FIG. 3A.

FIGS. 3A-3C illustrate one embodiment of the upper shaft seal isolation system 200 (which may be used as the system 30, FIG. 1). A bearing retainer 160*a* connected to an upper gear case housing 160*r* maintains main shaft bearings 160*b* in vertical position. The bearing retainer 160*a* has a platform portion 160*c* which is raised above a mounting flange 160*d* of the bearing retainer 160*a*. An upper shaft seal assembly 160*e* is mounted on the platform 160*c*. A shroud 160*f* secured to the main shaft 160 extends down and around the bearing retainer 160*a*.

The shroud 160*f* rotates with the main shaft 160 and protects the seal assembly 160*e* from contamination (e.g., contamination from substances in the environment and from leaking drilling fluid. Part 160*g* of the shroud 160*f* extends radially outwardly to direct fluid outwardly and away from the seal assembly 160*e*. The shroud 160*f* may be in contact with the platform 160*c* and/or with the bearing retainer 160*a*; or, as shown, the shroud 160*f* may be spaced apart from the platform 160*c* and/or from the bearing retainer 160*a* with an open space therebetween.

The washpipe 108 has packings 115 and 117.

It is within the scope of the present invention to employ a shaft seal isolation system according to the present invention (any disclosed herein) on the main shaft of any top drive.

Figure 4:
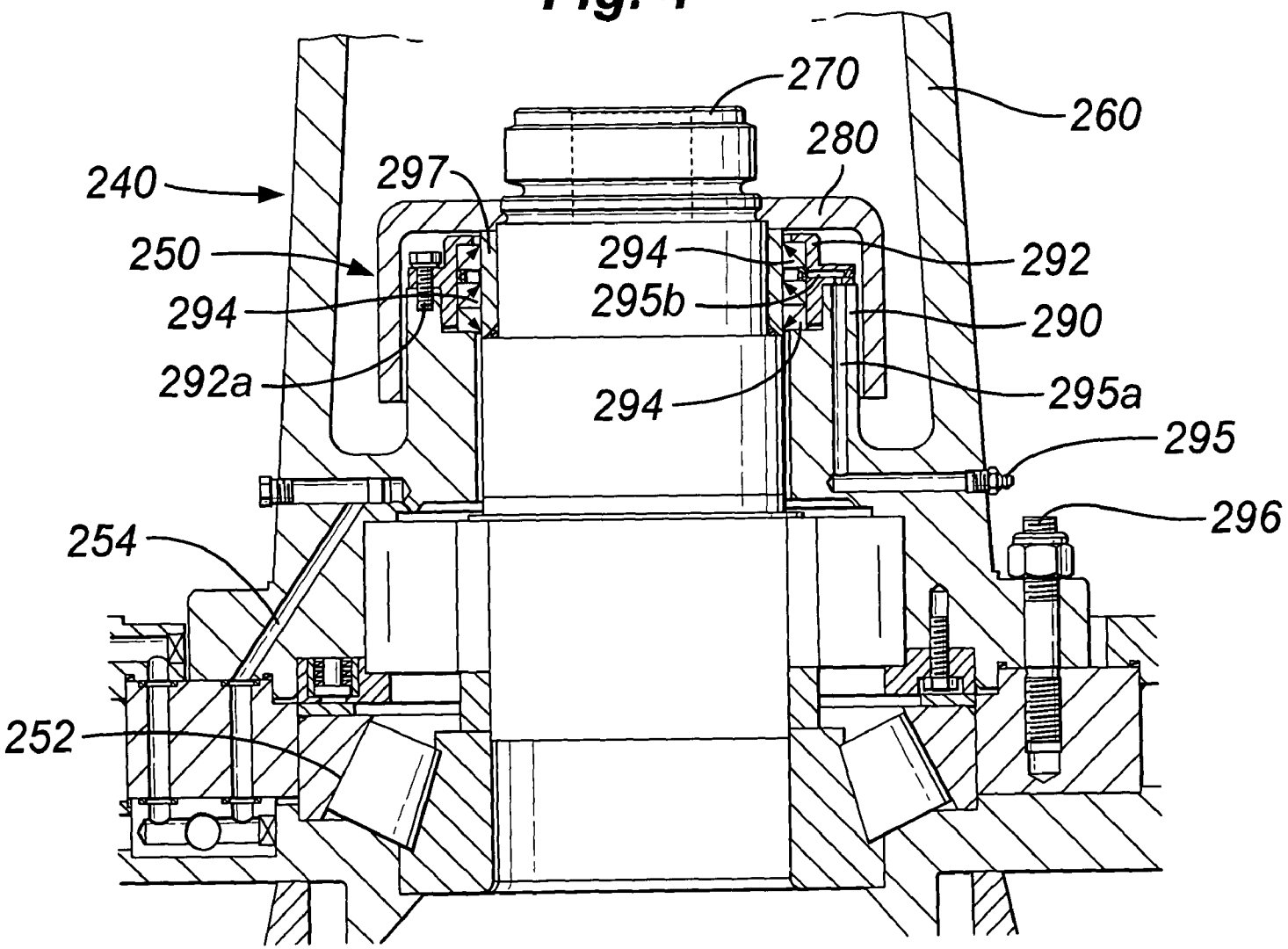
FIG. 4 is a cross-section view of a shaft isolation system according to the present invention.

FIG. 4 shows a top drive 240 (shown partially) with a seal isolation system 250 (which may be used as the system 30, FIG. 1). The top drive 240 has a main shaft 270; a bearing system 252; and a lubrication system 254. An upper shroud 280, secured to the main shaft 270, encloses part of a seal platform 290 and an upper seal housing 292 which is secured to the seal platform 290. A seal or seals 294 in the upper seal housing 292 sealingly contact a seal wear ring 297 on the main shaft 270 as it rotates. The shroud 280 rotates with the main shaft 270. Optionally the shroud 280 extends down to the upper seal housing 292 or, as shown, extends down past the upper seal housing 292. A bonnet 260 surrounds the seal isolation system 250 and the top of the main shaft 270. The seal platform 290 may be secured to or formed of any suitable structure of the top drive. As shown, the seal platform 290 is formed of part of the bonnet 260. Bolts 296 (one shown) bolt the bonnet 260 to the top drive. The seal housing 292 is bolted to the bonnet 260 with bolts 292*a*. Lubricant is applied to the seals 294 via channels 295*a* and 295*b*. Removable plug 295 closes off the channel 295*a*. Optionally, a labyrinth non-contact isolator is used instead of the seals 294—and air is applied to the isolator via the channels 295*a* and 295*b*. Air constantly flows up and out to assist in excluding contaminants from entering the isolator.

The present invention, therefore, provides in some, but not in necessarily all, embodiments a top drive system for wellbore operations, the top drive system including: a main body; a motor apparatus; a main shaft extending from the main body, the main shaft having a top end and a bottom end, the main shaft having a main shaft flow bore therethrough from top to bottom through which drilling fluid is flowable; a gear system interconnected with the motor apparatus; and an upper shaft seal isolation system.

The present invention, therefore, provides in some, but not in necessarily all, embodiments such systems in which the upper shaft seal isolation system includes the upper main shaft seals located below a high pressure swivel seal and housed on a raised platform above a main bearing/gear housing with a protective shield or shroud surrounding the main shaft seal and the platform. The raised platform containing the upper seal is supported by a cylindrical or conical housing which extends downward to the top of the main bearing/gear housing. The shroud surrounds the upper shaft seal and its cylindrical support; is circumferentially affixed to the main shaft above the upper shaft seal, preventing leakage between the main shaft and the shroud from above; and rotates with the main shaft.

The present invention, therefore, provides in some, but not necessarily all, embodiments a top drive system for wellbore operations, the top drive system including: a top drive main shaft; a housing enclosing a portion of the top drive main shaft, the portion of the main shaft having an exterior surface; the housing including a raised platform; a seal system for sealing an interface between the housing and the portion of the top drive main shaft, the seal system having seal apparatus on and supported by the raised platform and the seal apparatus including at least one seal on the raised platform and adjacent the exterior surface of the portion of the main shaft enclosed within the housing; and the at least one seal located so that contaminants are flowable down from the at least one seal. Such a top drive system may have one or some, in any possible combination, of the following: a shroud connected to and rotatable with the top drive main shaft, and the shroud extending downwardly adjacent the seal system and covering the seal system; the shroud extending downwardly beyond a level of the seal system; the shroud spaced apart from the raised platform by an open space; a wear ring on the top drive main shaft, the at least one seal adjacent and in contact with the wear ring; and/or lubrication apparatus in communication with the at least one seal for lubricating the at least one seal.

The present invention, therefore, provides in some, but not necessarily all, embodiments a top drive system for wellbore operations, the top drive system including: a top drive main shaft; main shaft bearings in contact with the main shaft; a housing enclosing a portion of the top drive main shaft, the portion of the main shaft having an exterior surface; a bearing retainer adjacent the main shaft for maintaining the main shaft bearings in position; a raised platform on the bearing retainer; a seal system for sealing an interface between the housing and the portion of the top drive main shaft, the seal system having seal apparatus on and supported by the raised platform, the seal apparatus including at least one seal between the raised platform and the exterior surface of the portion of the main shaft enclosed within the housing, and the at least one seal located so that contaminants are flowable down from the at least one seal. Such a top drive system may have one or some, in any possible combination, of the following: a shroud connected to and rotatable with the top drive main shaft, and the shroud extending downwardly adjacent the seal system and covering the seal system; the shroud extending downwardly beyond a level of the seal system; the shroud spaced apart from the raised platform by an open space; a wear ring on the top drive main shaft, the at least one seal adjacent and in contact with the wear ring; and/or lubrication apparatus in communication with the at least one seal for lubricating the at least one seal.

The present invention, therefore, provides in some, but not necessarily all, embodiments a method for sealing an interface between a top drive system's main shaft and a housing of the top drive system, the top drive for wellbore operations, the method including: positioning at least one seal adjacent a main shaft of a top drive system; the at least one seal on a raised platform of the top drive system and located so that contaminants are flowable down from the at least one seal; the method further including sealingly contacting the main shaft of the top drive system with the at least one seal while the main shaft is rotating. Such a method may have one or some, in any possible combination, of the following: shrouding the seal apparatus with a shroud, the shroud connected to and rotatable with the top drive main shaft, and the shroud extending downwardly adjacent and the seal system and covering the seal system; the shroud extending downwardly beyond a level of the seal system; the shroud spaced apart from the raised platform by an open space; the top drive system having a wear ring on the top drive main shaft, the at least one seal adjacent and in contact with the wear ring; and/or wherein the top drive system including lubrication apparatus in communication with the at least one seal for lubricating the at least one seal, the method further including lubricating the at least one seal.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A top drive system for wellbore operations, the top drive system comprising a top drive main shaft, a housing enclosing a portion of the top drive main shaft, said portion of the main shaft having an exterior surface, the housing including a raised platform, a seal system for sealing an interface between the housing and the portion of the top drive main shaft, the seal system comprising seal apparatus on and supported by the raised platform and the seal apparatus including at least one seal on the raised platform and adjacent the exterior surface of the portion of the main shaft enclosed within the housing, and the at least one seal located so that contaminants are flowable down from the at least one seal and, a shroud connected to and rotatable with the top drive main shaft, the shroud extending downwardly adjacent the seal system and covering the seal system.

2. The top drive system of claim 1 wherein the shroud extends downwardly beyond a level of the seal system.

3. The top drive system of claim 2 wherein the shroud is spaced apart from the raised platform by an open space.

4. The top drive system of claim 2 further comprising a wear ring on the top drive main shaft, the at least one seal adjacent and in contact with the wear ring.

5. The top drive system of claim 1 further comprising lubrication apparatus in communication with the at least one seal for lubricating the at least one seal.

6. A top drive system for wellbore operations, the top drive system comprising a top drive main shaft, main shaft bearings in contact with the main shaft, a housing enclosing a portion of the top drive main shaft, said portion of the main shaft having an exterior surface, a bearing retainer adjacent the main shaft for maintaining the main shaft bearings in position, a raised platform on the bearing retainer, a seal system for sealing an interface between the housing and the portion of the top drive main shaft, the seal system comprising seal apparatus on and supported by the raised platform, the seal apparatus including at least one seal between the raised platform and the exterior surface of the portion of the main shaft enclosed within the housing, and the at least one seal located so that contaminants are flowable down from the at least one seal, and further comprising a shroud connected to and rotatable with the top drive main shaft, and the shroud extending downwardly adjacent the seal system and covering the seal system.

7. The top drive system of claim 6 wherein the shroud extends downwardly beyond a level of the seal system.

8. The top drive system of claim 7 wherein the shroud is spaced apart from the raised platform by an open space.

9. The top drive system of claim 7 further comprising a wear ring on the top drive main shaft, the at least one seal adjacent and in contact with the wear ring.

10. The top drive system of claim 6 further comprising lubrication apparatus in communication with the at least one seal for lubricating the at least one seal.

11. A method for sealing an interface between a top drive system's main shaft and a housing of the top drive system, the top drive for wellbore operations, the method comprising positioning at least one seal adjacent a main shaft of a top drive system, the top drive system comprising the main shaft, a housing enclosing a portion of the top drive main shaft, said portion of the main shaft having an exterior surface, the housing including a raised platform connected, the at least one seal part of a seal system for sealing an interface between the housing and the portion of the top drive main shaft, the seal system comprising seal apparatus on and supported by the raised platform and the seal apparatus including the at least one seal, the at least one seal on the raised platform adjacent the exterior surface of the portion of the main shaft enclosed within the housing, the at least one seal located so that contaminants are flowable down from the at least one seal, the method further comprising sealingly contacting the main shaft of the top drive system with the at least one seal while the main shaft is rotating, and further comprising shrouding the seal apparatus with a shroud, the shroud connected to and rotatable with the top drive main shaft, and the shroud extending downwardly adjacent and the seal system and covering the seal system.

12. The method of claim 11 wherein the shroud extends downwardly beyond a level of the seal system.

13. The method of claim 12 wherein the shroud is spaced apart from the raised platform by an open space.

14. The method of claim 12 wherein the top drive system has a wear ring on the top drive main shaft, the at least one seal adjacent and in contact with the wear ring.

15. The method of claim 11 wherein the top drive system includes lubrication apparatus in communication with the at least one seal for lubricating the at least one seal, the method further comprising lubricating the at least one seal.

* * * * *